United States Patent [19]

Owens

[11] Patent Number: 5,054,142

[45] Date of Patent: Oct. 8, 1991

[54] CONTOURED BODY CUSHION

[76] Inventor: Thomas P. Owens, 1094 B St. #2, Ashland, Oreg. 97520

[21] Appl. No.: 504,705

[22] Filed: Apr. 4, 1990

Related U.S. Application Data

[63] Continuation of Ser. No. 163,337, Mar. 2, 1988, abandoned.

[51] Int. Cl.[5] ..... A47C 20/00

[52] U.S. Cl. ..... 5/431; 5/435; 5/443; 5/465

[58] Field of Search ..... 5/431, 432, 436, 437, 5/440, 462, 464, 465, 435, 443

[56] References Cited

U.S. PATENT DOCUMENTS

| | | | |
|---|---|---|---|
| D. 242,388 | 11/1976 | Castleberry | 5/436 X |
| 259,458 | 6/1981 | Fuller et al. | 91/171 |
| 271,647 | 12/1983 | McLeod | 273/387 |
| 1,499,013 | 6/1924 | Gunther | 5/66 |
| 1,548,728 | 8/1925 | Milam | 5/462 |
| 2,054,732 | 9/1936 | Saffrey | 128/72 |
| 2,089,854 | 2/1936 | Pellegrini | 5/446 |
| 2,182,861 | 12/1939 | Albert | 5/465 |
| 2,521,530 | 9/1950 | McGuffage | 5/449 |
| 2,878,153 | 3/1959 | Hackländer | 297/DIG. 1 X |
| 3,378,862 | 4/1968 | Skinner | 5/462 |
| 3,489,142 | 1/1970 | Golay | 128/74 |
| 3,608,103 | 9/1971 | Seid . | |
| 3,626,526 | 12/1971 | Viel | 5/465 |
| 3,639,927 | 2/1972 | Munch | 5/465 X |
| 3,795,018 | 3/1974 | Broaded . | |
| 3,808,615 | 5/1974 | Geary . | |
| 3,828,377 | 8/1974 | Fary, Sr. . | |
| 3,913,155 | 10/1975 | Eary, Sr. | 5/435 |
| 3,988,793 | 11/1976 | Abitbol . | |
| 4,021,872 | 5/1977 | Powell . | |
| 4,051,566 | 10/1977 | Esquivel . | |
| 4,054,960 | 10/1977 | Pettit et al. . | |
| 4,074,374 | 2/1978 | Ayesh . | |
| 4,128,272 | 12/1978 | Boyle | 5/465 X |
| 4,189,182 | 2/1980 | Rhoe | 5/432 X |
| 4,288,879 | 9/1981 | Pate | 5/431 |
| 4,394,783 | 7/1983 | Simmons | 5/432 |
| 4,574,786 | 3/1986 | Hashimoto et al. . | |
| 4,596,384 | 6/1986 | Blosser . | |
| 4,631,766 | 12/1986 | Semmler et al. . | |
| 4,648,389 | 2/1987 | Kowalski et al. . | |
| 4,664,593 | 2/1987 | O'Brien . | |
| 4,679,260 | 7/1987 | Frettem | 5/82 R |

*Primary Examiner*—Gary L. Smith
*Assistant Examiner*—Michael Milano
*Attorney, Agent, or Firm*—Pennie & Edmonds

[57] ABSTRACT

A portable multi-component contoured body cushion for supporting at least portions of a body includes a head member configured and dimensioned for supporting the head portion, a chest member configured and dimensioned for supporting the chest portion, and an abdomen member configured and dimensioned for supporting the abdomen. If desired, an ankle bolster configured and dimensioned for supporting the lower leg and ankle portions is also provided. The chest member is formed of a plurality of preformed sheets of uniform thickness configured so as to provide recesses to accommodate the breasts and abdomen of the body and to provide supports at least for the sternum and collar portions. The abdomen member is formed of a plurality of preformed sheets of uniform thickness positioned one atop the other. This abdomen member is also configured so as to provide support for the pelvic region so as to generally straighten the lumbar spinal curve. The individual members are freely movable independent of each other so as to be portable and capable of selective relative positioning so as to accommodate the configuration of the body. Preferably, the individual members are enclosed in vinyl.

44 Claims, 9 Drawing Sheets

CONTOURED BODY CUSHION

This is a continuation of application Ser. No. 07/163,337, filed Mar. 2, 1988, now abandoned.

FIELD OF THE INVENTION

This invention generally relates to a body support system and, in particular, to a contoured multi-component cushion for supporting a body during various procedures.

BACKGROUND OF THE INVENTION

During medical or therapeutic procedures it is desirable to support various portions of the body. Such procedures include chiropractic, obstetrical, massage and physical therapy treatments. For example, in the course of treating problems concerned with human vertebrae, a patient typically is placed face down or prone on the table. Thereafter the vertebrae's alignment is observed and felt by the therapist who can apply various forces on one or more of the vertebra to realign them relative to adjacent vertebra Because of the forces that may be applied, the body can experience various degrees of discomfort. For example, downward pressure on the spine and the chest area of a female would produce stretching of the soft breast tissues when the chest is supported on a flat table.

Accordingly, body support systems have been developed in order to alleviate some of the discomfort experienced during the aforementioned procedure. For example, U.S. Pat. No. 3,988,793 is directed to a mattress which is designed for preventing and treating toxemia in pregnant women. The mattress includes a chamber formed within an inflated tube or a ring. The chamber is open at the top and accommodates the abdominal wall which floats freely in the chamber. Additional apertures are provided to receive the breasts and feet of the patient. Other mattresses with cavities are illustrated in U.S. Pat. Nos. 4,021,872 and 4,051,566.

An adjustable bed with flat surfaces that can be positioned at different elevations is illustrated in U.S. Pat. No. 3,795,018. Adjustable body support devices are also illustrated in U.S. Pat. Nos. 3,828,377 and 3,913,155. Chiropractic tables are disclosed in U.S. Pat. Nos. 1,499,013 and 4,596,384. In the latter, a table includes separate support surfaces for the head, chest-abdomen and hip areas.

Notwithstanding the advantages provided by such body supportive devices noted above, these devices are limited in that they do not provide contoured supports for the various body portions when positioned upon such supports. I have invented an apparatus for supporting at least portions of a body. A feature of my invention includes a portable contoured multi-component cushion that overcomes these limitations and is adjustable for supporting body portions during various procedures such as chiropracity, massage and the like. Moreover, this contoured cushion provides an advance over known support systems in that it provides pelvic support to straighten the lumbar spinal curve without impinging on the lower abdominal organs such as the bladder and male genitalia. Additionally, it provides anterior cervical flexion by positive elevation by supporting the chest primarily on the bony structure of the clavicles, sternum and below the breasts on the ribs while the area under the abdomen is recessed. When the patient is in the supine position, i.e., lying on the back, the abdominal recess or cavity provides access to the spine. This cavity permits the therapist to insert his hands while still resting on the floor or table to treat the long muscles on either side of the spine. This cavity also can be used to accommodate positioning of electrodes during the course of electrical muscle stimulation.

Thus, the contoured cushion of the present invention can accommodate any body of various sizes including pregnant women in the prone position even for extended periods of time. This cushion converts an ordinary flat treatment table into an effective prone treatment table relatively quickly and easily. Although the contoured cushion is primarily intended as a prone positioning support, it also serves as an effective support for the body in the supine position as well.

SUMMARY OF THE INVENTION

The present invention is directed to an apparatus for supporting at least portions of a body comprising first member configured and dimensioned for supporting the head portion, second member configured and dimensioned for supporting the chest portion, the second member formed of a plurality of preformed sheets configured so as to provide recesses to accommodate the breasts and abdomen of the body and to provide supports at least for the sternum and collar portions, third member configured and dimensioned for supporting the abdomen, the third member formed of a plurality of preformed sheets positioned one atop the other, the third member also being configured so as to provide support for the pelvic region so as to generally straighten the lumbar spinal curve, fourth member configured and dimensioned for supporting the lower leg and ankle portions, and the members being freely movable independent of each other so as to be portable and capable of selective relative positioning so as to accommodate the configuration of the body.

The first member is formed of a generally flat board and a plurality of foam blocks positioned on top of the board in a generally circular pattern so as to provide supporting surfaces at least at the forehead and the side facial portions of the head portion. Preferably each foam block has a generally U-shaped cross-sectional configuration. First separable engagement means are positioned on at least one surface of each of the foam blocks and on one surface of the board so as to permit selective positioning of the foam blocks on the board. Each foam block also is enclosed preferably in vinyl.

The second member is formed of three foam sheets positioned one on top of the other. One of the foam sheets is a base sheet having a generally rectangular configuration. The remaining foam sheets are generally congruous and have a t-shaped portion attached to a generally rectangular portion. The t-shaped portion define recesses to accommodate the breasts and providing supports for the sternum and collar and the rectangular portion includes a recess to accommodate the abdomen. The base sheet has at least two generally curved corners. Also the corners of the rectangular portion adjacent to the t-shaped portion are generally curved. As was the case with the foam blocks of the first member, the foam sheets are enclosed in vinyl. In an alternative embodiment, an intermediate foam sheet is positioned between the base sheet and the remaining sheets.

Referring to the third member, it is preferably formed of at least five foam sheets positioned one on top of the other. One of the sheets is a base sheet having a generally rectangular configuration. The second sheet is positioned on top of the base sheet and is generally of a U-shaped configuration. Similarly, the third sheet is positioned on top of the second sheet and has a configuration generally congruous to that of the second sheet but has a width which is less than that of the second sheet. Each of the second and third sheets defines a recess between the arms of the U-shaped configuration so as to accommodate the abdomen. The fourth sheet consists of two separate L-shaped configurations positioned on top of the arms of the third sheet. The fifth sheet is formed of two separate generally rectangular blocks positioned on the fourth sheet. Once again, the plurality of sheets of the third member are enclosed in vinyl.

The fourth member is formed of a generally rectangular foam block having a generally flat surface for supporting the lower leg and ankle portions. Preferably the generally rectangular foam block has at least one shaved edge so as to provide support for the lower leg and ankle portions. This generally rectangular foam block is also preferably enclosed in vinyl.

The first member is coupled to the second member by second engagement means to permit selective relative positioning of the first and the second members and wherein the t-portion of the second member is closest to the first member. Similarly, the second member is coupled to the third member by third separable engagement means to permit selective relative positioning of the second and the third members and wherein the recesses for the abdomen in the second and third members face each other. The second and third separable engagement means each comprise at least one strap separably coupled to the respective members. Preferably each sheet is of a predetermined and uniform thickness. The apparatus of the present invention further comprises a bag dimensioned and configured for containing the first, second, third and fourth members therein.

According to an alternative embodiment of the present invention, an apparatus for supporting at least portions of a body comprises first means configured and dimensioned for supporting the head portion, second means configured and dimensioned for supporting the chest portion, the second means configured so as to provide recesses to accommodate the breasts and abdomen of the body and to provide supports at least for the sternum and collar portions, and third means configured and dimensioned for supporting the abdomen, the third member also being configured so as to provide support for the pelvic region so as to generally straighten the lumbar spinal curve. The first, second and third means are freely movable independent of each other so as to be portable and capable of selective relative positioning so as to accommodate the configuration of the body.

The present invention also is directed to a two segment treatment table wherein the segments are not coplanar. Preferably, the second member and the third member are positioned on one of the table segments and the fourth member is positioned on the other segment. Also one segment is angularly elevated relative to the other segment.

BRIEF DESCRIPTION OF THE DRAWINGS

The present invention is described in detail below with reference to the drawings wherein.

DETAILED DESCRIPTION OF THE INVENTION

In the description which follows, any reference to either direction or orientation is intended primarily and solely for purposes of illustration and is not intended in any way as a limitation of the scope of the present invention. Also, the particular embodiments described herein, although being preferred, are not to be considered as limiting of the present invention. Furthermore, like parts or elements in the various drawings hereto are identified by like numerals for ease of reference.

Figure 1:
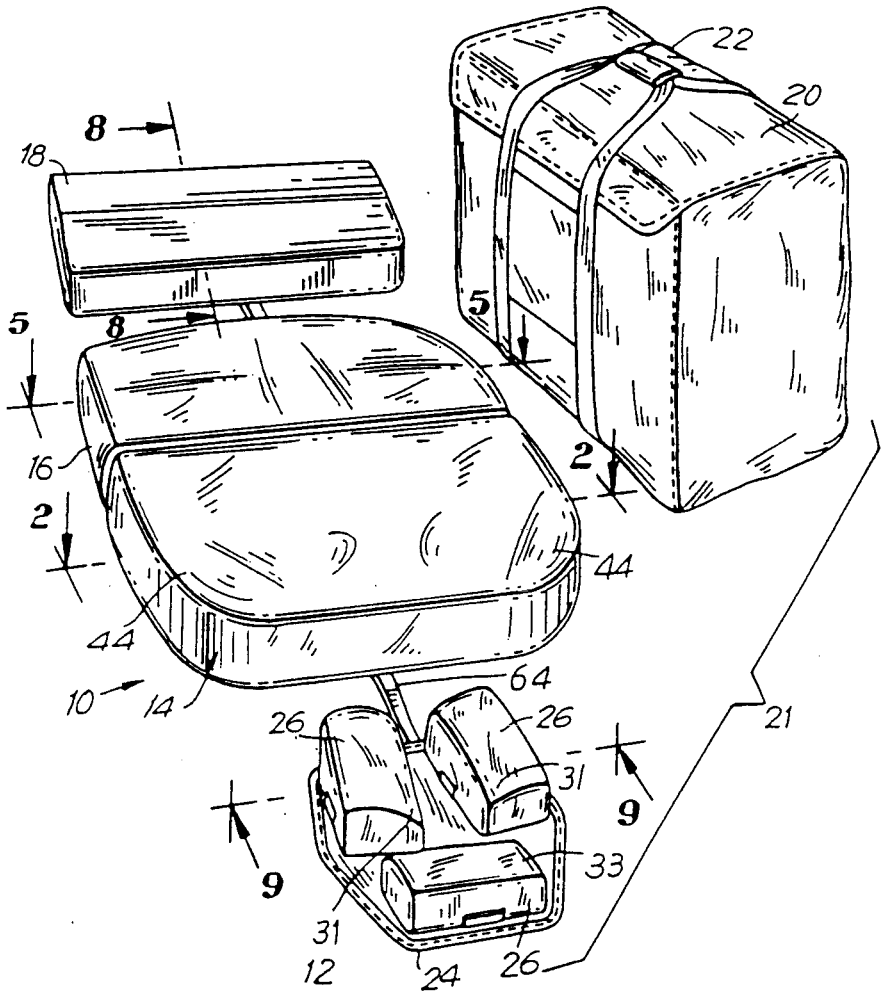
FIG. 1 is a perspective view of a multicomponent cushion for supporting a body according to the present invention.
Figure 12:
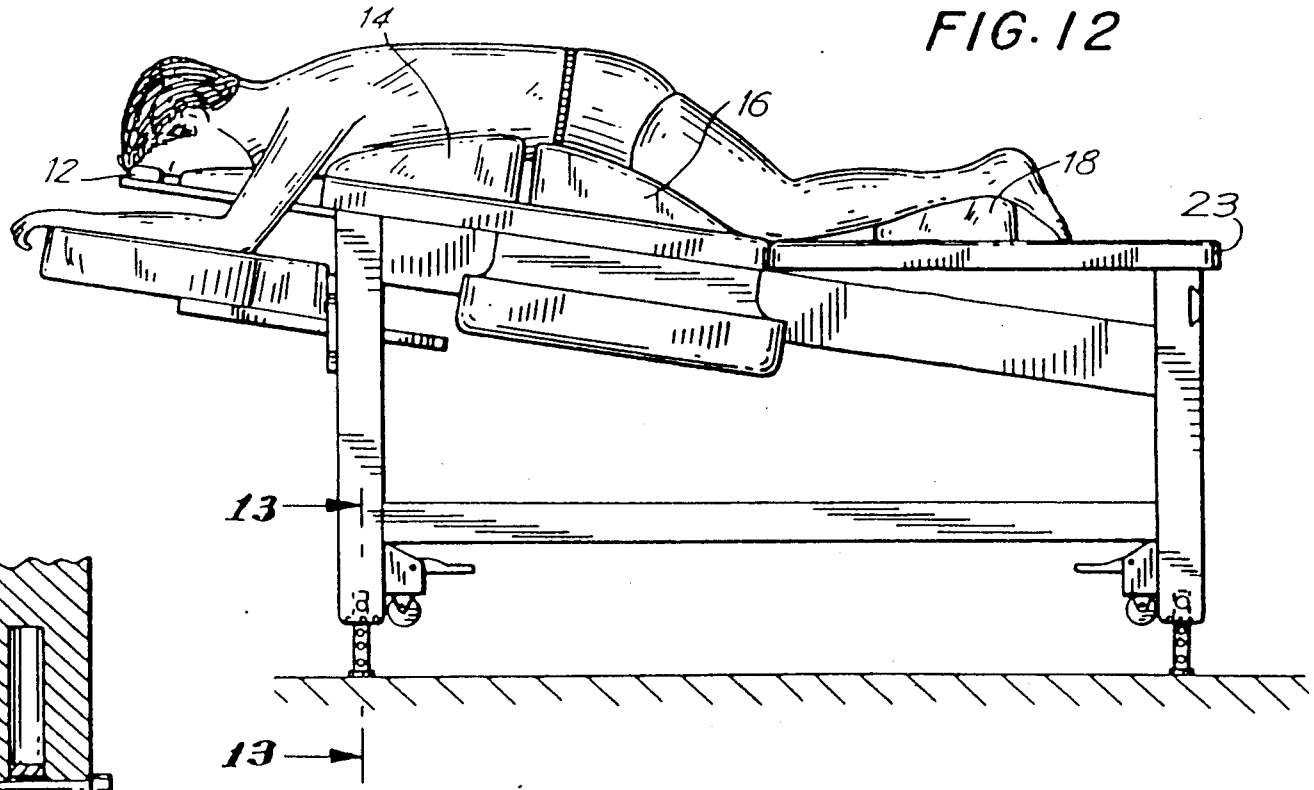
FIG. 12 is a side elevational view of a body laying face down on the multi-component cushion of FIG. 1 positioned atop a support table.
Figure 14:
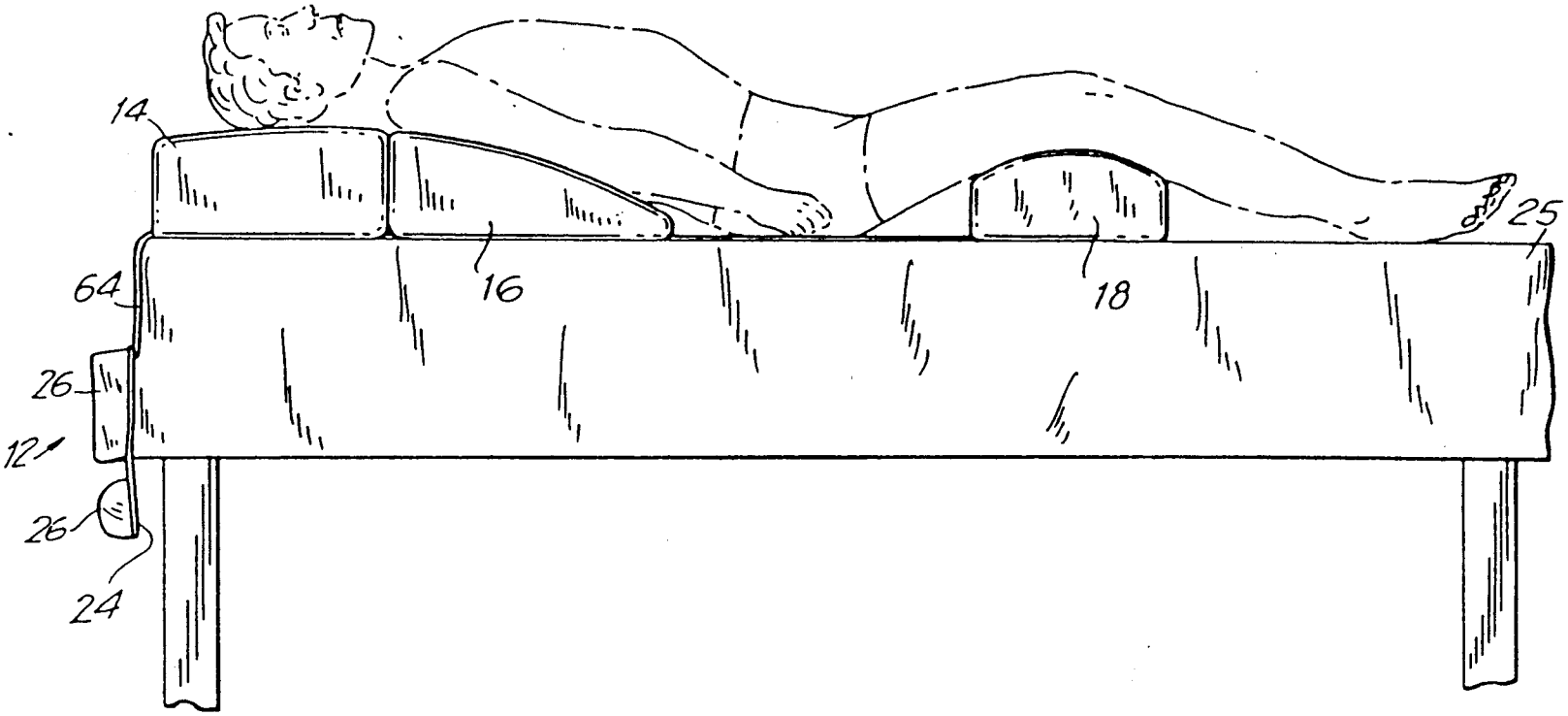
FIG. 14 is a side elevational view of a body in the supine position on the multi-component cushion of FIG. 1 positioned atop a support table.
Figure 18:
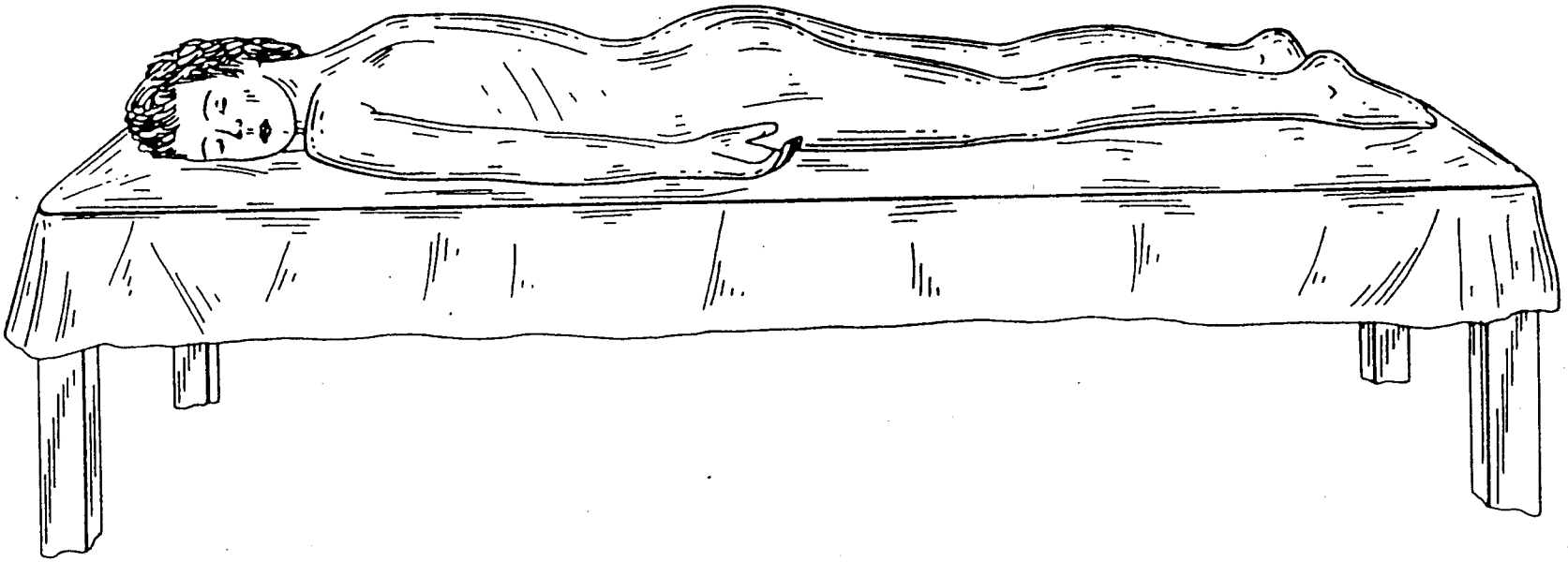
FIG. 18 is a perspective view of a patient on a flat treatment table without benefit of the contoured body cushion of the present invention.

A contoured body cushion 10 according to the present invention is illustrated in FIG. 1 and includes a head member 12, a chest member 14, an abdomen member 16, and an ankle bolster 18. As illustrated in FIG. 1, the multi-component body cushion 10 is portable and can be placed on the floor for immediate use thereon. Alternatively, if desired, the cushion 10 or components thereof can be used on a table as shown in FIGS. 12 and 14. The individual members 12, 14, 16 and 18 are therefore portable and selectively adjustable in position relative to one another so as to accommodate the particular configuration of a human body to be treated. Typically, the body will lie face down on the cushion 10 in the prone position as in FIG. 12. However, the cushion 10 can also accommodate the body on its back in the supine position as will be discussed more fully below and as shown in FIG. 14. Without the cushion 10, a person simply lays on a flat table according to the prior art as shown in FIG. 18 without the benefits of the cushion 10 as set forth herein. In the case of the flat table of FIG. 18, there is no support for the face or neck and moreover the patient must rest on one of the facial cheeks in an uncomfortable manner. Also, there is no pelvic or ankle and leg support.

In aid of the portability of the cushion 10 of the present invention, a suitably sized traveling bag 20 is provided in which the various members can be positioned and contained for ease of transportation. The bag 20 is generally rectangular in configuration and has a handle strap 22 which encloses the bag 20 as shown in FIG. 1. Together, the cushion 10 and bag 20 form a convenient travelling unit 21 that is readily transportable. Alternatively, the cushion 10 can be conveniently assembled in folded form and is transportable in that configuration as well.

Figure 11:
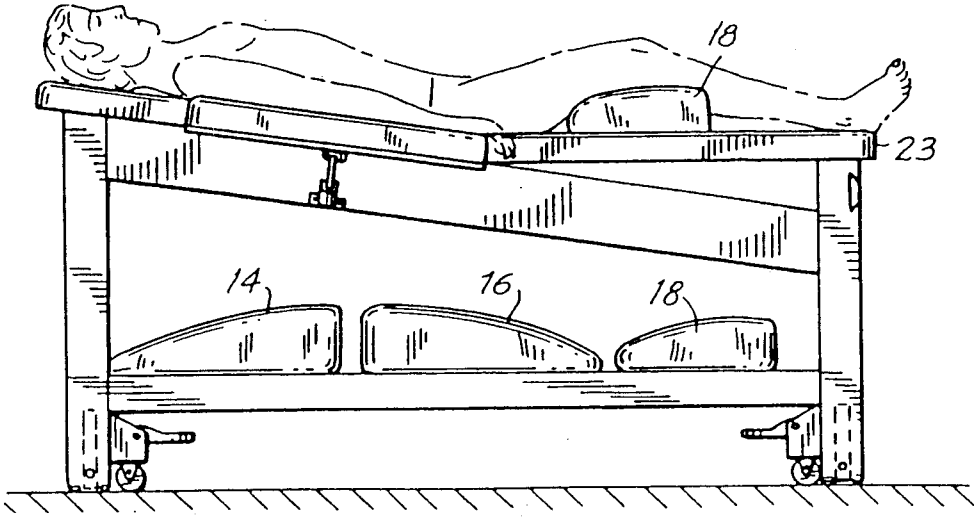
FIG. 11 is a side elevational view of the body of FIG. 10 laying head down on the face support component of FIG. 1.

As illustrated in FIGS. 10–13, the body cushion 10 can also be positioned upon a two segment table 23 also in accordance with the present invention or on a typical flat table 25 as shown in FIG. 14, if desired, in order to elevate the patient for ease of treatment by the therapist. However, as noted the cushion 10 can be placed directly on the floor without need of any table. Accordingly, the portability of the cushion 10 is not dependent on any accompanying table. Instead, the cushion 10 is fully portable since it can be employed either indoors or outdoors on the ground or the floor. As shown in FIG. 11, the table 23 can accommodate storage of the cushion 10 components on a shelf when not in use. Notably, the various components of cushion 10 can be used together as in FIG. 1 or separately as desired. For example, in FIGS. 10 and 11, the patient is in the supine position on table 23 with the ankle bolster 18 in position. The bolster 18 by virtue of its configuration, as described in more detail below, allows support without impingement of nerves and blood vessels behind the knee.

Figure 9:
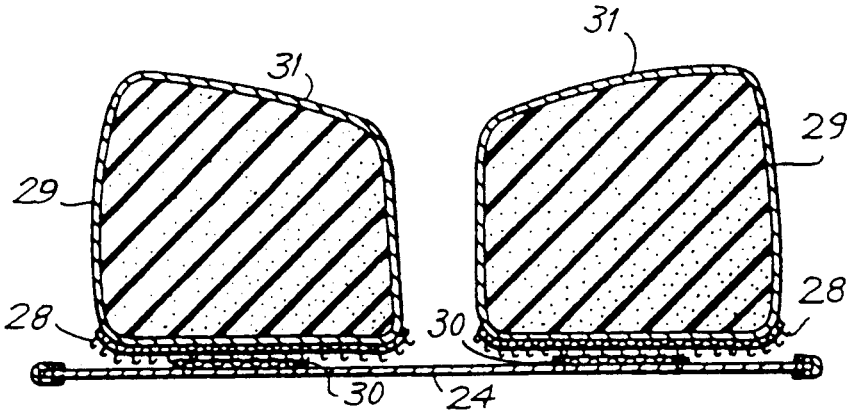
FIG. 9 is a cross-sectional view of the face support component as shown in FIG. 1 taken along the lines 9—9 of FIG. 1.
Figure 10:
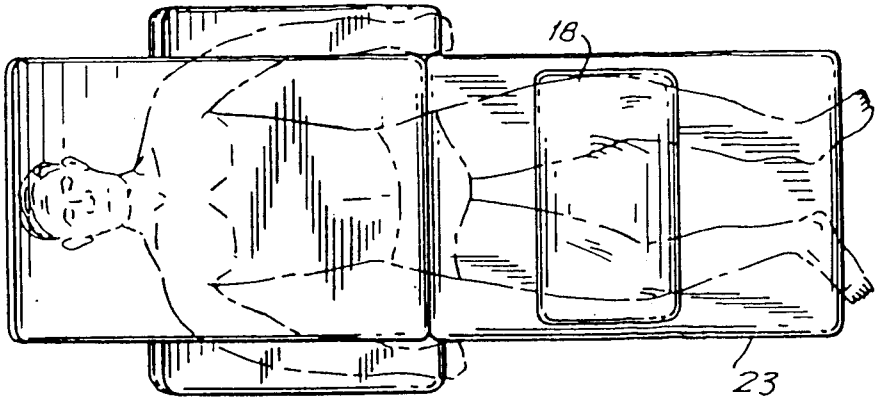
FIG. 10 is a top view of a body laying head down on the face support component of the contoured cushion of FIG. 1 positioned atop a support table.

Referring to FIGS. 1 and 9, the first member or face support 12 includes a flat board 24 on which are positioned three foam blocks 26 that are preferably enclosed in vinyl. The foam blocks 26 form with the flatboard 24 a generally U-shaped cross-sectional configuration in cross-section as demonstrated in FIG. 9. The three blocks 26 are positioned in a generally circular orientation so as to provide supporting surfaces to accommodate at least the forehead and the side facial portions of the head. As more clearly demonstrated in FIG. 9, the blocks 26 have separable engagement elements 28 such as strips of Velcro tape which are positioned on at least one surface, preferably the bottom, of each of the foam blocks 26. These engagement elements 28 cooperate with other corresponding engagement elements 30 that are positioned on the upper surface of board 24. Elements 30 are also formed of suitable strips Velcro tape. Accordingly, the foam blocks 26 can be positioned in any desired orientation on board 24. Preferably the blocks 26 are positioned in a generally circular pattern so as to support at least the forehead and the side facial portions of the head. To aid in stabilizing the head, two of the blocks 26 each have a sloped portion 31 which slopes generally toward the center of the blocks 26 when positioned on the board 24.

In a preferred embodiment, two of the foam blocks 26 which are for the cheeks of the face (sides of the face) are formed of fire retardant foam material and are generally rectangular having a dimension of five and one-half inches by three and a half inches and which stand three and one-half inches high. One of the foam blocks which is for the forehand is two and one-quarter inches high. As noted, these blocks are enclosed in vinyl-like material 29 and are positioned on top of the base 24 which itself is enclosed in two layers of vinyl. The first separable engagement means 28 and 30 preferably are six inch strips of Velcro which allow for selective positioning of the foam blocks 26 on top of the board 24. As noted, the foremost positioned block has a smaller height surface 33 than that of the other two blocks 26. The lower height forehead pad 26 relative to the higher elevation of the chest component 14 allows anterior cervical flexicon (head and neck slightly forward) thus allowing some opening of the foramina (nerve exits) between the vertebrae and permitting better access to the neck.

Figure 2:
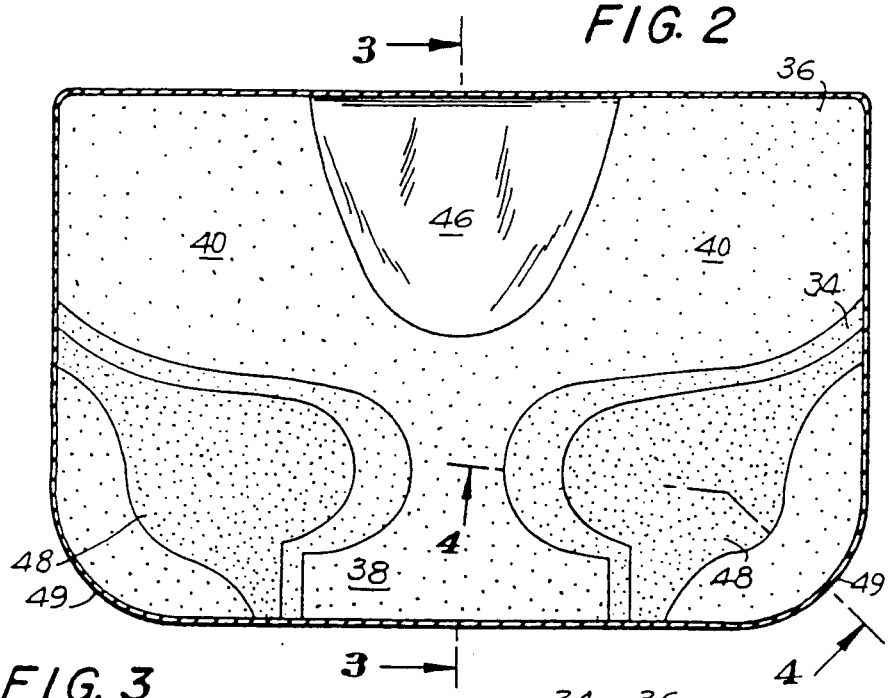
FIG. 2 is an exposed top view of the chest support component of the contoured cushion of FIG. 1.
Figure 3:
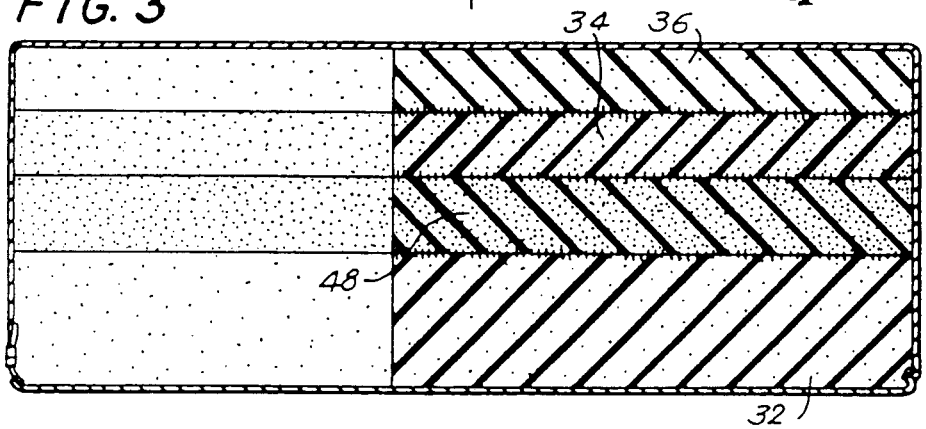
FIG. 3 is a cross-sectional view of the chest support component as shown in FIG. 1 taken along the lines 3—3 of FIG. 2.
Figure 4:
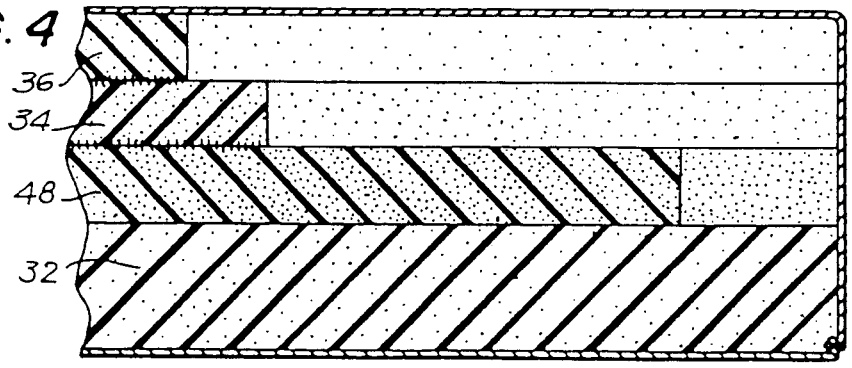
FIG. 4 is a cross-sectional view of the chest support component as shown in FIG. 1 taken along the lines 4—4 of FIG. 2.

The second and third members 14, 16, the chest and abdomen supports, respectively, are formed of laminated layers of foam sheets which have varying foam densities as set forth below. The second member 14 has a final dimension preferably about thirteen inches by twenty-three inches to a height of five inches. This second member 14 as shown in FIGS. 2, 3 and 4 is formed of at least three sheets wherein the base sheet 32 has a generally rectangular configuration. Positioned on top of the base sheet 32 are two generally like-shaped or congruent foam sheets 34 and 36 each of which has a t-shaped portion 38 that is attached to a generally rectangular portion 40. The t-shaped portion 38 defines two like-shaped recesses 44 as shown generally in FIG. 1 and FIG. 2 to accommodate the breasts and also provides support for the sternum and collar of the body. The rectangular portion 40 has a recess 46 as shown in FIG. 2 to accommodate the abdomen.

In the preferred embodiment illustrated in FIGS. 2–4, an intermediate foam sheet 48 is positioned between the base sheet 32 and the two t-shaped sheet members 34 and 36. Preferably the base sheet 32 has two corners which are curved 49. Also curved are the corners of each of the rectangular portions 40 adjacent to the respective t-shaped portions 38. As was the case with the foam blocks 26, the foam sheets of the second member 14 in their laminated configuration are enclosed in vinyl as well. However, the vinyl 50 does not obstruct the recesses 44 and 46. Each of the separate foam sheets of the second member 14 are uniformly approximately one inch thick. Overall, the chest support 14 has dimensions of thirteen inches by twenty-three inches with a height of five inches.

Figure 5:
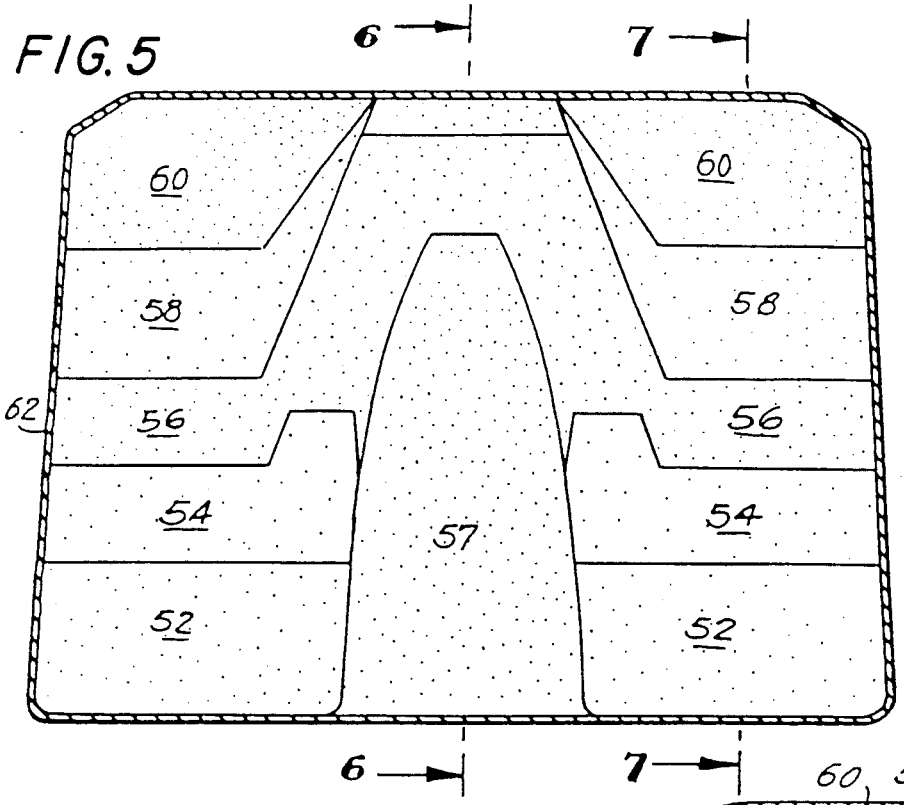
FIG. 5 is an exposed top view of the abdomen support component of the contoured cushion of FIG. 1.
Figure 6:
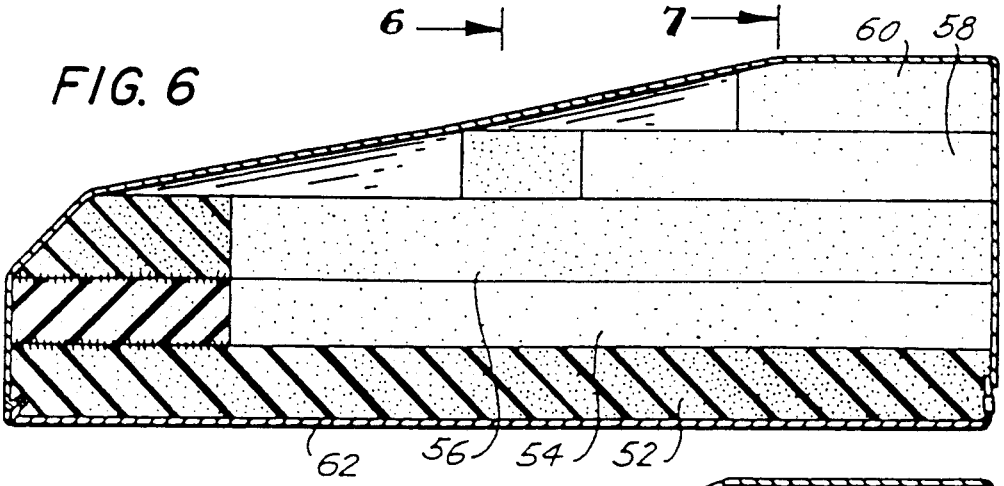
FIG. 6 is a cross-sectional view of the abdomen support component as shown in FIG. 1 taken along the lines 6—6 of FIG. 5.
Figure 7:
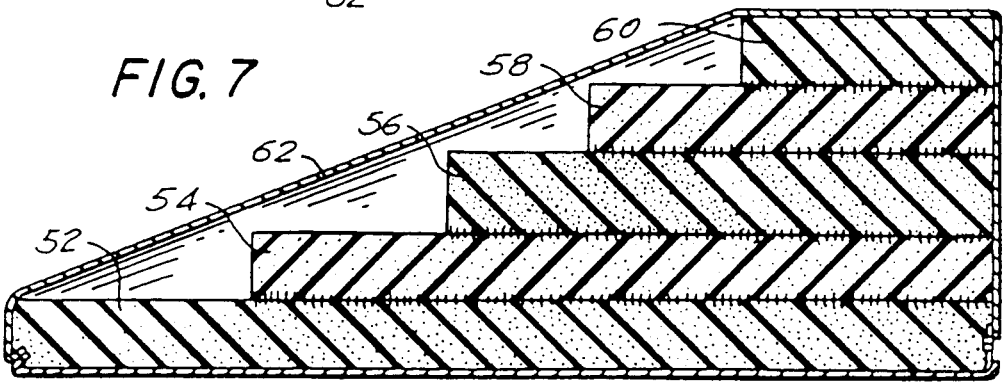
FIG. 7 is a cross-sectional view of the abdomen support component as shown in FIG. 1 taken along the lines 7—7 of FIG. 5.

Referring now to FIGS. 5, 6 and 7, the third member or abdomen support 16 is formed of at least five foam sheets positioned one on top of the other in a laminated configuration as was the case with the second member 14. Preferably the base sheet 52 is generally rectangular and has positioned thereon a second sheet 54 and a third sheet 56 each of which has a generally U-shaped configuration as shown in FIG. 5 and is positioned on top of the base sheet 52. As shown in FIGS. 5 and 7, the second and third sheets 54, 56 have the general same overall dimensions but sheet 56 has a smaller width than sheet 54. The second and third sheets 54, 56 each define a recess 57 between the arms of the U-shaped configuration so as to accommodate the abdomen. The fourth sheet 58 consists of two separate L-shaped pieces which are positioned as shown in FIG. 7 on top of the arms of the third sheet 56. Notably, the fourth sheet pieces 58 do not interfere with the recess 57 formed between the arms of sheets 54 and 56. Finally, the fifth sheet is formed of two separate blocks 60 which have a generally rectangular appearance in cross-section as shown in FIG. 6, but which are respectively configured as shown in FIG. 5 which are respectively positioned on the fourth sheet pieces 58 as shown in FIG. 7. The five sheets forming the third member or abdomen support of the cushion 10 are enclosed in a vinyl covering 62. As was the case with the chest support 14, the vinyl 62 does not obstruct the recess 57 which is formed by the laminated sheets which comprise the abdomen support 16. Therefore, when the body is positioned on top of the second and third members, the recesses are available to accommodate the respective body portions without any interference from the vinyl enclosures 50 and 62. In general, the abdomen support 16 has an overall dimension of seventeen inches by twenty-three inches and a height of five inches.

As shown in FIG. 1, the chest 14 and abdomen 16 supports are generally positioned so that the t-shaped portion 38 is adjacent the first member 12. Also, the recess 57 of the abdomen support 16 faces the recess 46 of the chest support 14. As illustrated in FIG. 1, the first member 12 is preferably coupled or connected to the chest support 14 by a two inch Velcro tape 64. Similarly the chest support 14 is attached to the abdomen support 16 by suitable lengths of two inch strips of Velcro tape 64 as well. In the folded configuration, these tapes keep the various components together.

Figure 8:
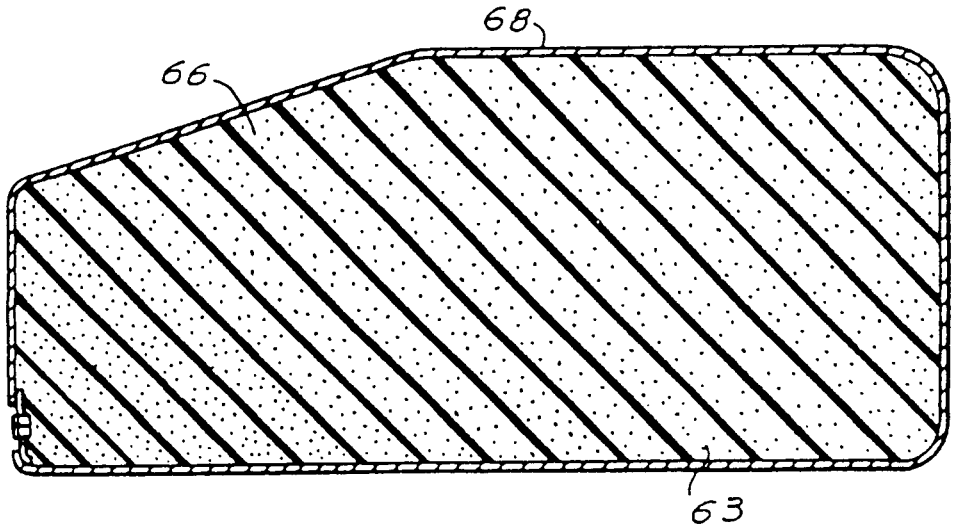
FIG. 8 is a cross-sectional view of the ankle support component as shown in FIG. 1 taken along the lines 8—8 of FIG. 1.

Referring to FIG. 8, the fourth member or ankle support 18 is formed of a foam block 64 which has a shaved or inclined edge 66. Once again, the foam block 63 is completely enclosed in a vinyl covering 70. The ankle support 18 is not coupled to any other support member but is free to be positioned as desired. Alternatively, it too can be coupled by a suitably sized tape. In a preferred embodiment, the foam block 66 is eleven inches by twenty-three inches and four inches high.

Listed below is an overall presentation of the thickness, density (in pounds) and indentation load deflection ("I.L.D.") for the various sheets and foam blocks of the different support components of the cushion 10. Preferably each of the foam sheets or blocks is formed of fire retardant material.

| Support | Thickness | Density (lb.) | I.L.D.* |
|---|---|---|---|
| Face (3) | | 1.9 | 35 |
| Chest (4 sheets) | | | |
| Base sheet | 2" | 2.2 | 50 |
| 2nd sheet | 1" | 1.8 | 24 |
| 3rd sheet | 1" | 2.2 | 35 |
| Top sheet | 1" | 2.2 | 35 |
| Abdomen (5 layers, 7 pieces) | | | |
| Base sheet | 1" | 2.2 | 50 |
| 2nd sheet | 1" | 2.2 | 35 |
| 3rd sheet | 1" | 2.2 | 35 |
| 4th layer (2 pieces) | 1" | 2.2 | 50 |
| 5th layer (2 pieces) | 1" | 2.2 | 35 |

-continued

| Support | Thickness | Density (lb.) | I.L.D.* |
|---|---|---|---|
| Bolster | | | |
| 1 piece | | 1.8 | 24 |

*Indentation Load Deflection

As noted above, the contoured cushion 10 of the present invention can be easily contained and transported within the bag 20 to any desired location. There, the components of the cushion 10 can be removed from the bag and positioned on the floor as shown in FIG. 1. In this configuration, the face support 12 is situated by means of Velcro strap 64 forward of the t-shaped portion 38 within the chest support 14. Thereafter, the abdomen support 16 can be selectively positioned at the desired distance from the chest support 14 so that the recess 57 of the abdomen support 16 is facing the recess 46 of the chest support 14. A Velcro strap as shown in FIG. 12 can be used to maintain the chest and abdomen supports 14, 16 in their relative selected positions. Finally, the ankle support 18 can be positioned rearward of the abdomen support 16 to accommodate the particular configuration of the body to be supported on the cushion 10.

Figure 13:
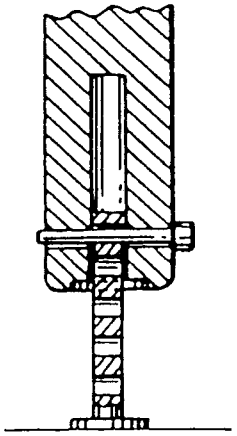
FIG. 13 is a cross-sectional view of one of the legs of the support table of FIG. 12 taken along the lines 13—13 of FIG. 12.
Figure 15:
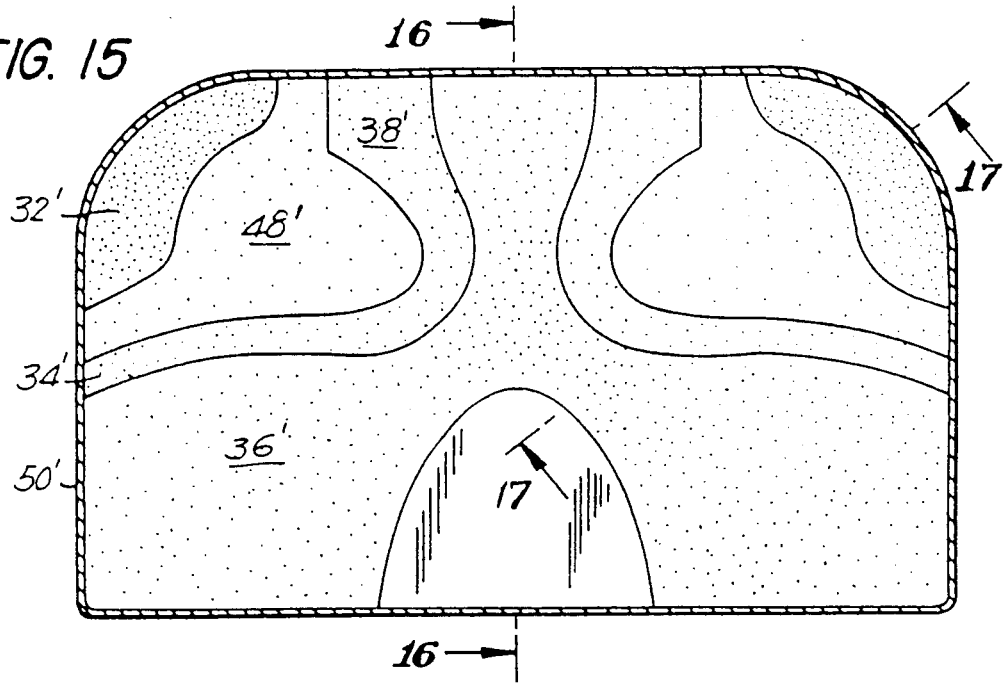
FIG. 15 is an exposed top view of an alternative embodiment of the chest support component of the contoured cushion of FIG. 1.
Figure 16:
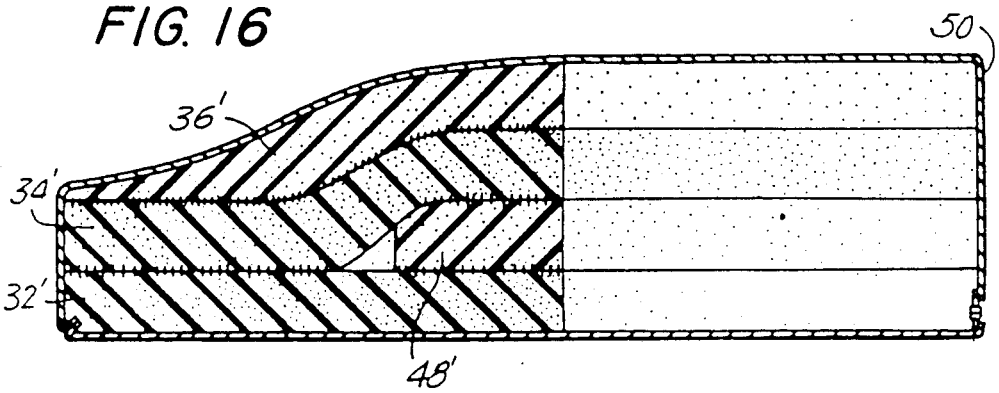
FIG. 16 is a cross-sectional view of the alternative chest support component taken along the lines 16—16 of FIG. 15.
Figure 17:
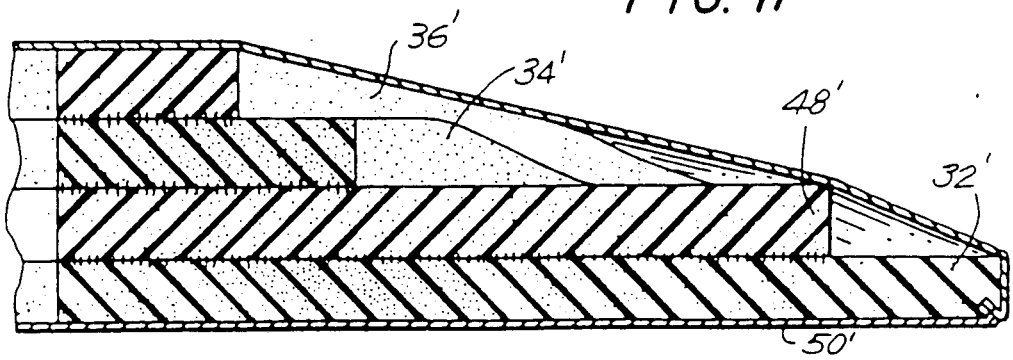
FIG. 17 is a cross-sectional view of the alternative chest support component taken along the lines 17—17 of FIG. 15.

Alternatively, as shown in FIGS. 10–13 the cushion 10 can be positioned on a table 23 which includes adjustable legs 74 and a fixed two segment table 76. The two segments are not co-planar and preferably the forward segment is angularly elevated as shown in FIGS. 11 and 12. Side arm supports 78 and 80 can be swung outwardly into position in order to accommodate the arms of the patient shown in a prone position, face down, in FIG. 12. The various components of the cushion 10 are selectively positioned by means of the adjustable Velcro straps in order that the different components can be relatively positioned to accommodate the particular configuration of the patient. In this respect, the face is supported in a face support which is part of and attached to the table 23. The chest support 14 is replaced with an alternative embodiment of a chest support 14' as shown in FIGS. 15–17 that is of a declining aspect toward the head end of the table 23 to allow transition of the body into the face support attached to the head end of the table as shown in FIG. 13. Accordingly, the alternative chest support 14' has no face support attached and has no attachment to the abdomen support 16 (by the same means as the chest support 14 attaches to 16). The reason for no attachment is that:

1. allows for adjusting positioning after client-/patient/subject is prone (easily separated); and 2. ease of removal from beneath the subject/individual when the individual is still prone just before rolling them over to the supine position on the table without the cushions (removal from the side of the individual). The chest support 14' and abdomen support 16 are positioned under the respective body portions. Finally, the ankle support 18 with the sloped or shaved portion 66 is positioned to support the ankles and lower leg portions so that the latter can rest upon the sloped portion 66. In this configuration, the knees can rest upon the table 23 or upon the floor in the event that the table is not employed or if resting the knees on a hand surface is not desired, the bolster can be positioned closer to the knees to elevate the knees slightly. In the event that the cushion 10 is employed on a floor, then the side arm support 78 or 80 are not necessary. Alternatively, the patient can rest the leg portions on the table without the need for the ankle support 18.

Referring to FIGS. 15–17, the alternative chest support 14' has a similar configuration to that of chest support 14 shown in FIGS. 2–4. However, the top sheet 36' has less of a t-shaped configuration than does sheet 34'. Moreover, intermediate sheet 48' is configured under the t-shaped portion 38' to allow the sheets 34' and 36' to decline as shown in FIG. 16.

In the arrangement as shown in FIG. 12, the cushion 10 provides pelvic support in order to straighten the lumbar spinal curve without impinging on the lower abdominal organs such as the bladder or male genitalia. In addition, the cushion 10 is clearly adjustable to accommodate various body lengths as well as being easily portable within the bag 20. Also, the cushion 10 provides anterior cervical inflection by the positive elevation of the chest piece and the lower forehead block by supporting the chest primarily on the bony structure of the clavicles, sternum and below the breast on the ribs while the area under the abdomen is recessed to avoid any impingement. In this manner, the cushion 10 can convert an ordinary flat treatment table into an effective prone treatment table in a quick and easy manner. The cushion 10 therefore can accommodate by virtue of its contoured step laminated form various bodies of different adult sizes including a full-term pregnant patient. Notably the vinyl covers yield into the recessed areas and therefore do not obstruct the recesses provided by the laminated configuration of the chest 14 and abdomen 16 supports.

Although the chest, abdomen and face supports are shown attached by a single Velcro strap, any number of additional straps can be employed as desired in order to provide the necessary positional stability once the selective adjustment of the various components is made. The face support preferably is attached to the chest support with webbing (nonseparable) rather than Velcro. That webbing (strapping) becomes a handle for the face/chest when folded. There are small Velcro tabs sewn onto the face support base, chest cushion,. and cushion to provide a tight/compact unit of these three pieces when folded. Also, a towel can be inserted between the chest and abdomen supports for further stabilization, if desired. Notably, the abdomen 16 is positioned under the patient's anterior superior spine of the ilium thereby positioning the patient with anterior pelvic tilt. This removes the lumbar or secondary spinal curve and thereby removes any pressure on the lumbar soft tissues such as disc, ligaments, tendons, muscles and nerves. Also, this opens the foramina between the vertebrae which takes the weight off the intervertebral discs. This allows the discs to expand to nearly their full potential in the first ten minutes of prone positioning and results in extended alleviation of pressure on the spinal nerves. This positioning is achieved without impinging on the patient's bladder or organs and is obtained by virtue of the various laminated configuration which not only provides support but also distributes the body weight while at the same time yielding into the recessed areas any intrusion of the body to accommodate the body in a comfortable manner.

The ankle bolster 18 is of a generally flat broad aspect to support the legs over a larger surface and thus not impinge on vessels and nerves. This allows a longer positioning of the patient with relative comfort. Typically round bolsters would cut off the blood supply to the feet and legs or lower legs.

Preferably the carrying bag 20 has a dimension of twenty inches by twenty-two inches and is eleven inches wide and weighs approximately twelve pounds with the component parts of cushion 10. Thus, the cushion 10 is relatively lightweight, compact, easily portable while allowing for quick and easy conversion of an ordinary treatment table to an effective prone treatment table as well.

In the prone position, two anatomical relationships are established. The elevated chest support 14 and the lower forehead support establishes anterior cervical inflection. With the arms in a forward position, relax inflection of the upper trapezius is also achieved thus allowing easy manipulation of the lower scapula. The second relationship is anterior lumbar inflection, that is, straightening of the lumbar spine as noted above by supporting the weight of the pelvis on the anterior-superior iliac spine of the ilium without impinging on the bladder or on internal or external organs. The chest support 14 with its recesses 44 do not impinge on a female's breast. In the prone positioning of a pregnant patient, the cushion 10 provides for release of the pressure ordinarily produced by the pregnant uterus in the abdominal wall on the abdominal aorta. This helps to prevent complications of pregnancy such as toxemia and fetal distress. In addition, deep breathing is achieved with relative comfort in a prone position. The cushion 10 thereby allows for a variety of therapies to the posterior aspect of the body such as heat, ice, TENS, diathermy, muscle stimulation massage, chiropractic and postoperative back surgery. In addition, the easily transportable cushion 10 can be carried with an athletic team for sport use. In addition, the cushion 10 can be easily transported for outpatient calls and even positioned for home care.

Notably by placing the patient's elbow in a prone position close to the body's longitudinal middle line, that is, arms in a forward position, there is enough positive elevation of the chest support 14 to allow for the elevation of the scapula. This allows both of the operator's hands to be used at the same time. The thumbs and the fingers of both hands are free to mobilize the scapula which is important in deep cross-friction and trigger point therapies. Usually one of the operator's or therapist's hands is used to elevate the shoulder, thus elevating the scapula. This is unnecessary with the use of the cushion 10. Thus a more controlled and effective treatment can be achieved with the multi-component contoured cushion 10 of the present invention.

Inasmuch as the cushion 10 is designed to accommodate the body in a prone position for extended periods of time, the cushion 10 can also be employed to support the patient's body in the supine or face up position as well. Such supine positioning allows access to the thoracic spine from beneath the patient. In this configuration as shown in FIG. 14, the therapist's hands can work freely in the abdominal recess. Also long term patients can use this cushion in order to avoid or reduce the risk of decubitous ulcers inasmuch as a patient can lie face down comfortably for extended periods of time. In this respect, the cushion 10 can be used in convalescent homes for long term bedridden patients. In use the nurse places the cushion 10 on the bed beside the patient and rolls the patient over onto the cushion 10. In this manner, the patient can receive a back rub—the area of risk for ulcers. Then the patient can be left for an extended period of time to nap face down.

The use of the cushion 10 supporting a patient in the supine position affords enough positive torso elevation with the head at the top resting on the sternum portion of the chest support 14 as shown in FIG. 14 to allow posterior extension of the shoulder joint without forcing the posterior aspect of the pectoral girdle into the table edge. This allows for effective manipulation of the shoulder joint and stretch of pectoralis majors and minors. In this configuration, the abdominal recess 46 becomes a spinal access by providing a cavity of free space for the operator's or therapist's hands to work the long muscles on either side of the spine without lifting the hands from the table surface. This creates excessive forces to the fingers, hands and wrists without risking injury such as total carpal syndrome. As shown in FIG. 14, when the patient is lying on the cushion 10 in the supine position, the ankle support 18 is placed under the knees as shown also in FIG. 11. Also the cavity formed in this configuration can be used as a suitable space for electrodes and electrical muscle and nerve stimulation modalities. Without the cushion 10, usually the patient can only be face down as otherwise the electrodes would press into the spinal area. This limitation or problem is avoided by use of the cushion 10 of the present invention.

Variations of the above-described multicomponent contoured cushion 10 which involve minor changes are clearly contemplated to be within the scope of the present invention. In addition, minor variations in the design, angles or materials of the various components of the contoured cushion 10 are also contemplated to be within the scope of the present invention. These modifications and variations may be made without departing from the spirit and scope of the present invention, as will become apparent to those skilled in the art. The specific embodiments described herein are offered by way of example only, and the invention is limited only by the terms of the appended claims.

I claim:

1. Apparatus for supporting at least portions of a body comprising:

a. first member configured and dimensioned for supporting the heat portion;

b. second member configured and dimensioned for supporting the chest portion, said second member formed of a plurality of preformed sheets positioned one atop the other of generally decreasing area from said lowermost sheet to said uppermost sheet, at least the two upper of said sheets having respectively progressive arcuate cut-out portions which combine to provide generally stepped recesses to support and accommodate the breasts, said sheets further defining arcuate cut-out portions to provide a recess which supports and accommodates at least a part of the abdomen of the body while the remaining portions of said sheets are configured and dimensioned to provide support at least for the sternum and collar portions; aid recesses being generally formed by a generally t-shaped portion attached to two generally rectangular portions in each of said two upper sheets, at least a portion of aid second member being at a higher elevation than at least a portion of said first member so as to provide at least for anterior cervical flexion;

c. third member formed of a plurality of preformed sheets positioned one atop the other of generally decreasing area from said lowermost sheet to said uppermost sheet, at least the two upper of said sheets having arcuate cut-out portions which combine to provide a recess to support and accommodate at least a part of the abdomen of the body while the remaining portions of said sheets are configured and respectively progressively dimensioned to provide support for the pelvic region in a manner to generally straighten the lumbar spinal curve;

d. fourth member configured and dimensioned for supporting the lower leg and ankle portions; and e. said members being freely movable independent of each other so as to be portable and capable of selective relative positioning so as to accommodate the configuration of the body.

2. The apparatus of claim 1 wherein said first member is formed of a generally flat board and a plurality of foam blocks positioned on top of said board in a generally circular pattern so as to provide supporting surfaces at least at the forehead and the side facial portions of the head portion.

3. The apparatus of claim 2 wherein said foam blocks have a generally U-shaped configuration in the plan view.

4. The apparatus of claim 3 further comprising first separable engagement means positioned on at least one surface of each of said foam blocks and on one surface of said board so as to permit selective positioning of said foam blocks on said board.

5. The apparatus of claim 3 wherein each foam block is enclosed in vinyl.

6. The apparatus of claim 1 wherein said second member is formed of three foam sheets positioned one on top of the other.

7. The apparatus of claim 6 wherein one of said foam sheets is a base sheet having a generally rectangular configuration.

8. The apparatus of claim 7 further including an intermediate foam sheet positioned between said base sheet and said remaining sheets.

9. The apparatus of claim 8 wherein said base sheet has at least two corners generally curved.

10. The apparatus of claim 9 wherein the corners of said rectangular portion adjacent to said t-shaped portion are generally curved.

11. The apparatus of claim 10 wherein said foam sheets are enclosed in vinyl.

12. The apparatus of claim 1 wherein said third member is formed of at least five foam sheets positioned one on top of the other.

13. The apparatus of claim 12 wherein one of said sheets is a base sheet having a generally rectangular configuration.

14. The apparatus of claim 13 wherein said second sheet is positioned on top of said base sheet and is generally of a U-shaped configuration.

15. The apparatus of claim 14 wherein said third sheet is positioned on top of said second sheet and has a configuration generally congruous to that of said second sheet but has a width which is less than that of said second sheet.

16. The apparatus of claim 15 wherein said second and third sheets each define a recess between the arms of said U-shaped configuration so as to accommodate the abdomen.

17. The apparatus of claim 16 wherein said fourth sheet consists of two separate L-shaped configurations positioned on top of the arms of said third sheet.

18. The apparatus of claim 17 wherein said fifth sheet is formed of two separate generally rectangular blocks positioned on said fourth sheet.

19. The apparatus of claim 18 wherein said plurality of sheets of said third member are enclosed in vinyl.

20. The apparatus of claim 1 wherein said fourth member is formed of a generally rectangular foam block having a generally flat surface for supporting the lower leg and ankle portions.

21. The apparatus of claim 20 wherein said generally rectangular foam block has at least one shaved edge so as to provide support for the lower leg and ankle portions.

22. The apparatus of claim 21 wherein said generally rectangular foam block is enclosed in vinyl.

23. The apparatus of claim 1 wherein said first member is coupled to said second member by second engagement means to permit selective relative positioning of said first and said second members and wherein a t-portion of said second member is provided closest to said first member.

24. The apparatus of claim 23 wherein said second separable engagement means comprises at least one strap separably coupled to said first and said second members.

25. The apparatus of claim 1 wherein said second member is coupled to said third member by third separable engagement means to permit selective relative positioning of said second and said third members and wherein said recesses for the abdomen in said second and third members face each other.

26. The apparatus of claim 25 wherein said third separable engagement means comprises at least one strap separably coupled to said second and said third members.

27. The apparatus of claim 1 wherein each sheet is of a predetermined and uniform thickness.

28. The apparatus of claim 1 further comprising a bag dimensioned and configured for containing said first, second, third and fourth members therein.

29. The apparatus of claim 1 further comprising a two segment treatment table wherein said segments are not co-planar.

30. The apparatus of claim 29 wherein said second member and said third member are positioned on one of said table segments and said fourth member is positioned on said other segment.

31. The apparatus according to claim 30 wherein said one segment is angularly elevated relative to said other segment.

32. The apparatus according to claim 31 wherein said table includes adjustable legs.

33. Apparatus for supporting at least portions of a body comprising:

a. first means configured and dimensioned for supporting the head portion;

b. second means configured and dimensioned for supporting the chest portion, said second means being formed of a plurality of preformed sheets positioned one atop the other of generally decreasing area from said lowermost sheet to said uppermost sheet, at least two upper of said sheets having spaced apart progressively dimensioned arcuate cut-out portions which combine to provide generally stepped recessed configured and structured to support and accommodate the breasts while the remaining portions of said sheets are configured and dimensioned to provide transitional phase support for the adjacent body portions, said sheets further defining centrally located arcuate cut-out portions to provide a recess which supports and accommodates the abdomen of the body, the remaining portions of said sheets providing support at least for the sternum and collar portions, said recesses being generally formed by a generally t-shaped portion attached to two generally rectangular portions in each of said two upper sheets, at least a portion of said second member being at a higher elevation than at least a portion of said first member so as to provide at least for anterior cervical flexion;

c. third means configured and dimensioned for supporting the abdomen, said third means being formed of a plurality of preformed sheets positioned one atop the other of generally decreasing area from said lowermost sheet to said uppermost sheet, at least the two upper of said sheets defining arcuate cut-out portions which combine to provide a recess to support and accommodate at least a part of the abdomen of the body while the remaining portions of said sheets are respectively progressively dimensioned and configured as successive steps so as to provide support for the pelvic region so as to generally straighten the lumbar spinal curve; and d. said first, second and third means being freely movable independent of each other so as to be portable and capable of selective relative positioning so as to accommodate the configuration of the body.

34. The apparatus of claim 33 wherein said first means is formed of a generally flat board and a plurality of congruous vinyl enclosed foam blocks positioned on top of said board so as to provide supporting surfaces at least at the forehead and the side facial portions of the head portion.

35. The apparatus of claim 34 further comprising first separable engagement means positioned on at least one surface of each of said vinyl enclosed foam blocks and on one surface of said board so as to permit selective positioning of said foam blocks on said board.

36. The apparatus of claim 33 wherein said second means is formed of four foam sheets of a predetermined and uniform thickness positioned one on top of the other and enclosed in vinyl.

37. The apparatus of claim 33 wherein said third means is formed of at least five foam sheets of a predetermined and uniform thickness positioned one on top of the other and enclosed in vinyl.

38. The apparatus of claim 37 wherein one of said sheets is a base sheet having a generally rectangular configuration.

39. The apparatus of claim 38 wherein said second sheet is positioned on top of said base sheet and is generally of a U-shaped configuration.

40. The apparatus of claim 39 wherein said third sheet is positioned on top of said second sheet . and has a configuration generally congruous to that of said second sheet but has a width which is less than that of said second sheet.

41. The apparatus of claim 40 wherein said second and third sheets each define a recess between the arms of said U-shaped configuration so as to accommodate the abdomen.

42. The apparatus of claim 41 wherein said fourth sheet consists of two separate L-shaped configurations positioned on top of the arms of said third sheet.

43. The apparatus of claim 42 wherein said fifth sheet is formed of two separate generally rectangular blocks positioned on said fourth sheet.

44. Apparatus for supporting at least portions of a body comprising:

a. first means configured and dimensioned for supporting the head portion;

b. second means configured and dimensioned for supporting the chest portion in a manner which provides relatively firm support under the structural bone body portions while facilitating transitional cushioned and contoured support for the softer body portions adjacent said bone portions, said second support means being formed of a plurality of preformed sheets positioned and relatively attached one atop the other of generally decreasing area from said lowermost sheet to said uppermost sheet, and in face-to-face relation and progressively dimensioned and configured to include selectively positioned arcuate cut-out portions which combine to provide generally stepped recessed to provide contoured cushioned transitional phase support to accommodate the breast portion and a recess to support and accommodate at least a portion of the abdomen of the body and support at least for the sternum and collar portions, said recesses being generally formed by a generally t-shaped portion attached to two generally rectangular portions in each of said two upper sheets, at least a portion of said second member being at a higher elevation than at least a portion of said first member so as to provide at least for anterior cervical flexion;

c. third means configured and dimensioned for supporting the remaining portion of the abdomen, said third member being formed of a plurality of preformed sheets positioned one atop the other of generally decreasing area from said lowermost sheet to said uppermost sheet, and in face-to-face relation and relatively attached, said sheets having progressively selectively positioned stepped configurations which are dimensioned and configured to provide a recess to support for the pelvic region so as to generally straighten the lumbar spinal curve while defining a generally centrally located generally arcuate cut-out portion to accommodate at least a portion of the abdomen of the body; and d. said first, second and third means being freely movable independent of each other so as to be portable and capable of selective relative positioning so as to accommodate the configuration of the body.

* * * * *